United States Patent [19]

Lai

[11] 4,301,973

[45] Nov. 24, 1981

[54] BENEFICIATION OF IRON ORE

[75] Inventor: Ralph W. M. Lai, Lexington, Mass.

[73] Assignee: Kennecott Corporation, Stamford, Conn.

[21] Appl. No.: 104,671

[22] Filed: Dec. 17, 1979

[51] Int. Cl.[3] ..... B02C 19/00

[52] U.S. Cl. ..... 241/20; 209/3; 209/166

[58] Field of Search ..... 209/166, 167; 241/20, 241/24, 3

[56] References Cited

U.S. PATENT DOCUMENTS

| | | | |
|---|---|---|---|
| T980,002 | 3/1979 | Hsieh | 209/166 |
| 2,669,355 | 2/1954 | Archibald | 209/166 |
| 3,292,780 | 12/1966 | Frommel | 209/166 X |
| 3,589,622 | 6/1971 | Weston | 209/166 X |
| 3,779,380 | 12/1973 | Bishop | 209/166 |
| 4,132,638 | 1/1979 | Yang | 209/166 |

OTHER PUBLICATIONS

Chem. Abst., vol. 75, 1971, 8703a.

RI 5498, Dept. of Tnt, Coke & Numela, "Fatty and Resin Acids as Collectors for Iron Oxides", pp. 1–24, 1959.

Chem. Abst., 66, 1967, 21196W.

Chem. Abst., 75, 1971, 8705C.

Chem. Abst., 85, 1976, 7806F.

*Primary Examiner*—Robert Halper

*Attorney, Agent, or Firm*—John L. Sniado; Anthony M. Lorusso

[57] ABSTRACT

Isostearic acid, a liquid isomer of stearic acid, is used as an agent in a froth flotation process to concentrate the iron oxide in iron ores. By use of this flotation agent, the iron oxide in the ground ore is directly floated away from the remainder of the ore. The process enables a high amount of iron oxide to be concentrated from low grade ores.

12 Claims, 2 Drawing Figures

BENEFICIATION OF IRON ORE

BACKGROUND OF THE INVENTION

This invention relates generally to iron ore benefication and particularly to froth flotation for concentrating fine-grained iron ore.

Iron ore is an important mineral commodity because it is the primary source of iron, the metal most widely used by man. World production of iron ore in 1977 was estimated at 840 million tons, and an estimated 350 million tons was shipped in international trade.

The United States is the world's fourth largest producer of iron ore and is a major importer. Imports supply about one-third of the primary iron required by the U.S. steel industry. In contrast, imports supplied less than 5 percent of U.S. demand in 1953.

The decline in U.S. production was due to several factors. During World War II, it became apparent that U.S. reserves of high-grade ore would be seriously depleted by the 1950's. To secure additional supplies of ore, U.S. companies began an intensive search for deposits in foreign countries. These efforts were highly successful; large investments were made, and imports began in the early 1950's. Because most U.S. ore was relatively low grade and comparatively costly to produce, the increasing availability of low-cost, high-grade foreign ore became an important means of combating growing competition from the reconstructed steel industries of Europe and Japan. Of course, any technology which would enable low grade U.S. ore to be processed economically would be desirable because such technology would cut down U.S. dependance on foreign imports. A low grade ore which is present in great abundance in the United States is taconite. The term taconite was originally applied to the hard, fine-grained, banded iron-bearing formation of the Mesabi range. The term is now often used to describe similar rocks in other areas, such as "low grade deposits of the taconite type." If magnetite is the principal iron mineral, the rock is called magnetic taconite; if hematite is the principal iron mineral, the rock is called hematite taconite, oxidized taconite or non-magnetic iron ore. Because hematite taconite is non-magnetic, magnetic concentration of the iron oxide in the ore is not used because it is expensive and inefficient. Furthermore, because of the small grain size of the iron oxide components of both hematite taconite and magnetic taconite, these ores are difficult to float by known direct flotation techniques.

At this point, it should be noted that "direct" flotation is a process in which the iron oxide itself is floated away from the gangue or silica. Grinding of fine grained ores such as taconite produces a great deal of slime; and the physical and chemical properties of fine grained ores makes it difficult to process by froth flotation.

In addition, indirect flotation such as cationic flotation of fine grained ores is characterized by low recovery rates. Thus there is simply no effective procedure for concentrating such ores.

As would be expected, the literature is replete with various procedures for concentrating iron ores. Representative of such procedures are those described in U.S. Pat. Nos. 3,779,380 and 3,292,780.

U.S. Pat. No. 3,779,380 to Bishop describes ore beneficiation and particularly froth flotation applied to iron ore. The beneficiation process described enables direct flotation of the iron oxide. This process, however, is not as efficient when dealing with fine grained ores as is the present process.

U.S. Pat. No. 3,292,780 to D. W. Frommer et al. describes a process for improving flotation of iron ores by selective flocculation and flotation. In the process, the ore is ground, the iron oxides are selectively flocculated with starch while the silicate gangues are dispersed with sodium silicate. The fine silicates are removed by desliming and the coarse silicates are removed by cationic amine flotation. A commercial operation based on the above process is in operation in North America for processing a fine grained iron ore. The process is a technical success for treating fine-grained iron ore; however, the process has its drawback due to additional loss of iron in the slimes and hence a reduction in the iron unit recovery.

It would, of course, be desirable to provide a process for processing fine-grained iron oxide by a direct flotation of iron oxides without desliming.

Accordingly, it is an object of the invention to provide a particularly effective flotation agent, one that will allow the recovery of a maximum amount of iron from low grade iron ores.

Another object of the present invention is to process the fine grained iron oxides in ores such as taconite to recover maximum iron oxides in a direct flotation of iron oxides.

Another object of the invention is the provision of a direct flotation of iron oxides without desliming to reduce iron losses.

SUMMARY OF THE INVENTION

In practicing the present invention, isostearic acid, a liquid isomer of stearic acid, is used as a flotation agent in the beneficiation of fine-grained iron ores by direct flotation. By practicing the present invention, no depressants or activators are required and no slimes are removed. Furthermore, the process enables high yields even when the treated ore is low grade.

DESCRIPTION OF A PREFERRED EMBODIMENT

At the outset, the invention is described in its broadest overall aspects with a more detailed description following. The present invention concentrates the iron oxide in iron ore by direct flotation of that component of the ore. The process of the invention can be employed to great advantage when concentrating so-called fine grained ores. In connection with the term fine grained, it should be noted that the beneficiation of coarse ores usually requires only several stages of crushing, screening and hydraulic classification. Fine grained ores usually required more extensive fine grinding in order to liberate iron oxide from the ore.

For example, a coarse grained ore like specular hemitite requires grinding to about 200 mesh to liberate the iron oxide from the ore. Fine grained ore, on the other hand, such as that shown in FIG. 1, has to be ground to a smaller size in order to liberate the iron oxide component from the silica or gangue component of the ore.

Figure 1:
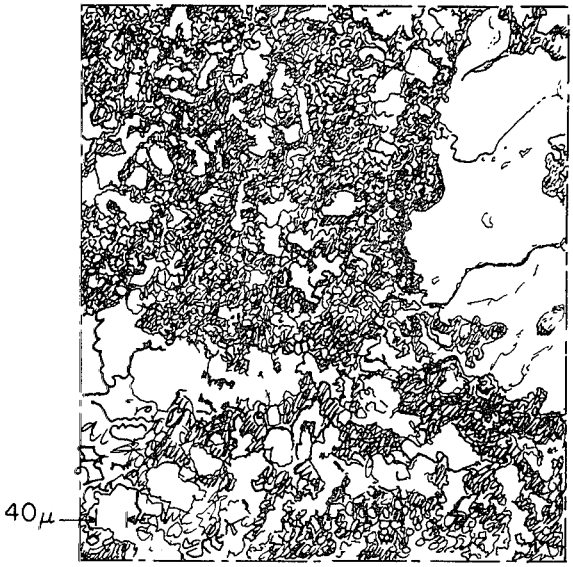
FIG. 1 is a reproduction of a photomicrograph of thin sections in polarized light of an untreated fine grained ore; and, FIG. 2 is a cross-sectional view of a flotation cell used to concentrate the iron oxide in fine grained ores in accordance with the present invention.

For example, in FIG. 1, the particles of the iron oxide component is less than 30μ. Thus, low grade ore of the type shown in FIG. 1 must be ground to about the size less than 30μ in order to liberate the iron oxide.

As stated above, however, the direct flotation of such fine grained particles posses many problems. In connection with the foregoing, the term fine grained, as used throughout this specification and claims, refers to an ore which has been ground to produce fine grained particles at least 70% by weight of which are less than 500 mesh U.S. sieve series. In practicing the invention, low grade ores such as taconite ore is fine ground in a rod and ball mill (not shown) so that at least 70% and preferably up to 95% of the ground ore is −500 mesh or less. Once the ore is ground to the fine grained state, it is introduced into a flotation cell such as that shown in FIG. 2; whereupon, the fine grained ore is directly floated to produce a concentrate of iron oxide.

Flotation is an important and widely used process for obtaining benefication. It is based on the fact that some of the components of the ore that are crushed and ground are wettable by water (hydrophilic), whereas other components are water-repellent (hydrophobic). The hydrophobic particles have an ability to attach to air bubbles by surface action, the nature of the film on the outside of the particles being the controlling factor. When air is introduced into the "pulp" mixture of solids and water in which flotation is performed, it adheres to the hydrophobic particles in the form of bubbles. This action causes the particles containing the attached bubbles to rise to the surface of the flotation cell such as that shown in FIG. 2. There they collect in a mass of froth and are removed by a skimmer device. The hydrophilic components remain behind in the pulp.

In the present invention, the flotation agent enables the ferrous oxides in the ore to attach to the bubbles and rise to the surface of the cell. Thus, in the present process, the ferrous oxides are the hydrophobic particles. In the present process, the silica (the hydrophilic component) remains in the cell. As has been stated above, this type of procedure is known as direct flotation and is distinguishable over many prior art processes in which the ferrous oxides are depressed (with the silica or gangue being the component which floats to the top of the cell).

The direct flotation of the ferrous oxides of the ore, in accordance with the present invention, is made possible by the use of isostearic acid as a flotation agent. Of course, it is known that the flotability of desired minerals can be enhanced by certain chemical additives called flotation agents. However, prior to the present invention, it had not been realized that the use of isostearic acid as a flotation agent would effectively enable the direct flotation of the ferrous oxides of low grade ores which have been ground to the fine grained size.

Isostearic acid is a complex mixture of saturated branched-chain $C_{18}$ fatty acid isomers. It is a liquid isomer of stearic acid (whose use as a flotation agent itself is known).

In practicing the invention, low grade iron ore is ground in water at any concentration suitable for handling purposes. The use of 30 to 70% solids is suggested, although the invention is not limited thereto. The pulp is conditioned with isostearic acid and a pH modifier. The pH modifier can be basic compounds such as sodium hydroxide, ammonium hydroxide, or sodium carbonate; which is a source of hydroxyl ions. In practicing the present invention, it is important that the pH of pulp be alkaline. However, no great advantage is achieved by increasing the alkalinity of the pulp to a pH greater than 10. Thus, the preferred range for the pulp is within the range of 7.1 to 10.0. The flotation agent used in this invention is isostearic acid which has the following physical characteristics as compared with the straight chained stearic acid:

| Content | Stearic Acid Saturated Straight-Chain $C_{18}$ Fatty Acid | Isostearic Acid Mixture of Saturated, Branched-Chain $C_{18}$ Fatty Acid Isomers |
|---|---|---|
| Titer, °C. | 54.5-55.0 | 8 |
| Acid Value | 206.0-209.0 | 177 |
| Saponification Value | 207.0-210.0 | 189 |
| Solid or liquid | cryst. masses | liquid |

In practicing the present invention, it is important that the isostearic acid be liquid at room temperature. It does not matter what the structural formula of the isostearic acid is so long as the flotation agent itself is liquid. Thus, the isostearic acid used in accordance with the present invention may contain various isomers of stearic acid. Isostearic acid is a commerical chemical obtained from Union Camp Corp. Isostearic acid dosages range from 0.2 lb/T to 4 lb/T (lb isostearic/ton ore).

Figure 2:
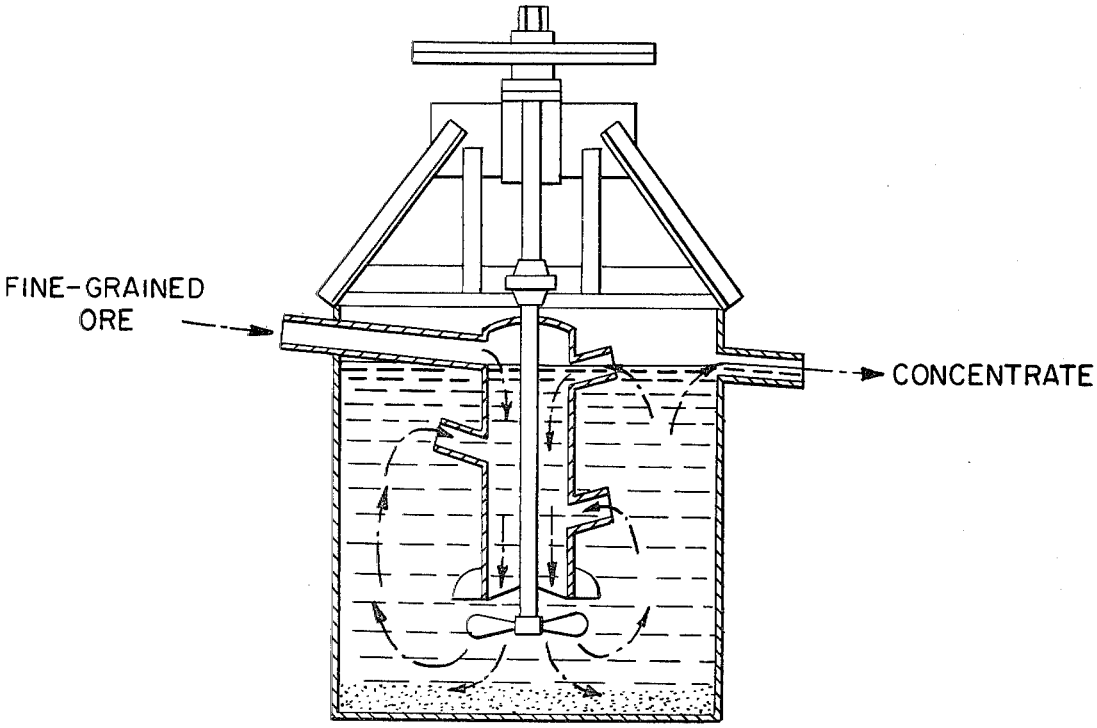

After the conditioning, more water is added if desirable before subjecting the pulp to flotation in a flotation cell such as that shown in FIG. 2.

After the final amount of water is added, the pulp is agitated by the impeller as shown in FIG. 2 to introduce air into the flotation cell and force the iron oxide component of the ore to the top of the cell where it can be collected as a concentrate.

The following are examples of flotation using isostearic acid as flotation agent. An example using normal stearic acid is also given for comparison.

EXAMPLE I

Use of Normal Stearic Acid

Four hundred grams of -10 mesh Michigan hematitic iron ore was ground with 270 ml demineralized water for 90 minutes in a rod mill. The pulp was conditioned with a 0.55 ml ammonium hydroxide and 0.68 grams normal stearic acid. The particle size of the ground ore has the following particle size distributions:

| | % Particles Passing μ Size | | | | | | | | | |
|---|---|---|---|---|---|---|---|---|---|---|
| | 62 | 44 | 31 | 22 | 16 | 11 | 7.8 | 5.5 | 3.9 | 2.8 |
| Run 1 | 92 | 92 | 86 | 67 | 53 | 38 | 26 | 19 | 11 | 5 |
| Run 2 | 97 | 97 | 86 | 67 | 54 | 40 | 27 | 18 | 10 | 6 |

The ground ore was then floated in a "WEMCO" bowl type flotation machine manufactured by Envirotech Corp.

The froth was collected and refloated a second time in a cleaner flotation cell. The tailings from the cleaner flotation are referred to as middlings. The metallurgical results are as follows:

| Material | Wt. % | % Fe | % Iron Distribution |
|---|---|---|---|
| Froth | 32.68 | 64.14 | 60.0 |
| Middlings | 14.91 | 40.54 | 17.3 |
| Tails | 52.41 | 15.12 | 22.8 |

EXAMPLE II

Use of Isostearic Acid

Four hundred grams of -10 mesh Michigan hematitic iron ore was ground with 270 ml demineralized water for 90 minutes in a rod mill. The pulp was conditioned with 0.38 ml ammonium hydroxide and 0.52 grams of isostearic acid. The particle size of the ground ore was at least 86% less than 31 μ.

The ground ore was then floated in a "WEMCO" bowl type flotation machine manufactured by Envirotech Corp.

The froth was collected and refloated a second time in a cleaner flotation. The tails from the cleaner flotation are referred to as middlings. The metallurgical results are as follows:

| Material | Wt. % | % Fe | % Iron Distribution |
|---|---|---|---|
| Froth | 50.9 | 65.75 | 91.42 |
| Middlings | 10.6 | 16.88 | 4.89 |
| Tails | 38.5 | 3.50 | 3.69 |

EXAMPLE III

Use of Isostearic Acid

Four hundred grams of -10 mesh Michigan hematitic iron ore was ground with 270 ml demineralized water for 90 minutes in a rod mill. The pulp was conditioned with 0.38 ml ammonium hydroxide and 0.39 gram isostearic acid.

Then the ground ore was floated in a WEMCO cell. After the rougher flotation, additional 0.05 grams of isostearic acid were added to the cell to scavenge more iron oxide. Afer additional flotation, the concentrates were combined and refloated a second time (cleaner flotation). The metallurgical results are as follows:

| Materials | Wt. % | % Fe | % Iron Distribution |
|---|---|---|---|
| Cleaner Froth | 53.1 | 64.24 | 94.68 |
| Cleaner Tails | 5.7 | 8.00 | 4.06 |
| Scavenger Tails | 41.3 | 3.55 | 1.26 |

EXAMPLE IV

Use of Isostearic Acid

Four hundred grams of -10 mesh Michigan hematitic iron ore was ground with 270 ml tap water for 90 minutes in a rod mill. The pulp was conditioned with 0.38 ml ammonium hydroxise and 0.39 grams isostearic acid.

The ground ore was floated in a WEMCO cell. The concentrate was collected and 0.05 grams more of isostearic acid were added to the cell for scavenging iron. After additional flotation, the tails were collected. The concentrations were combined and refloated using recycled water recovered from the filtered tails. The metallurigal results are as follows:

| Materials | Wt. % | % Fe | % Iron Distribution |
|---|---|---|---|
| Cleaner Froth | 51.4 | 66.00 | 92.77 |
| Cleaner Tails | 7.6 | 13.45 | 2.71 |
| Scavenger Tails | 41.0 | 4.02 | 4.52 |

EXAMPLE V

Four hundred grams of -10 mesh Michigan hemtitic iron oxide containing 2–5% goethite was ground with 270 ml demineralized water for 90 minutes in a rod mill. The pulp was conditioned with 0.22 ml ammonium hydroxide and 0.65 grams of isostearic acid. The ground ore was then floated in a WEMCO cell.

The concentrate was collected and the tails further scavenged with 0.05 grams more of isostearic acid. After scavenging, the tails were collected and filtered. The concentrates were combined and refloated a total of five times, each time the tails were scavenged with additional 0.05 grams of isostearic acid. The metallurgical results are as follows:

| Materials | Wt. % | % Fe | % Iron Distribution |
|---|---|---|---|
| Final Froth | 57.3 | 60.14 | 93.5 |
| Combined 4th & 5th Tails | 4.2 | 14.85 | 1.66 |
| Combined 1st, 2nd and 3rd Tails | 13.2 | 5.91 | 2.12 |
| Scavenged Tails | 25.3 | 3.96 | 2.72 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A process for concentrating iron oxide from an iron oxide containing ore comprising:

a. grinding the ore;

b. introducing the ground ore into a flotation cell in the form of pulp;

c. introducing a flotation agent into said pulp and maintaining the pH of the pulp alkaline, said flotation agent comprising an isostearic acid which is liquid at room temperature;

d. introducing air into the flotation cell to cause the iron oxide component of the ore to float away from remaining portions of the ore; and e. collecting the iron oxide component from the top of the cell.

2. The process as set forth in claim 1 wherein the ore is ground so that at least 70% by weight of the ground ore comprises particles which are less than 500 mesh.

3. The process as set forth in claim 2 wherein said ore is ground so that 95% of the particles are less than 500 mesh.

4. The process as set forth in claim 3 wherein said isostearic acid has the following physical properties:

| Content | Mixture of Saturated, Branched-Chain $C_{18}$ Fatty Acid Isomers |
|---|---|
| Titer, °C. | 8 |
| Acid Value | 177 |
| Saponification Value | 189 |

5. The process as set forth in claim 4 wherein said ore is a taconite ore.

6. The process as set forth in claim 3 wherein said ore is a taconite ore.

7. The process as set forth in claim 2 wherein said isostearic acid has the following physical properties:

| Content | Mixture of Saturated, Branched-Chain $C_{18}$ Fatty Acid Isomers |
|---|---|
| Titer, °C. | 8 |
| Acid Value | 177 |
| Saponification Value | 189 |

8. The process as set forth in claim 7 wherein said ore is a taconite ore.

9. The process as set forth in claim 2 wherein said ore is a taconite ore.

10. The process as set forth in claim 1 wherein said isostearic acid has the following physical properties:

| Content | Mixture of Saturated, Branched-Chain $C_{18}$ Fatty Acid Isomers |
|---|---|
| Titer, °C. | 8 |
| Acid Value | 177 |
| Saponification Value | 189 |

11. The process as set forth in claim 10 wherein said ore is a taconite ore.

12. The process as set forth in claim 1 wherein said ore is a taconite ore.

* * * * *